US008864265B2

(12) United States Patent
Hirai et al.

(10) Patent No.: US 8,864,265 B2
(45) Date of Patent: Oct. 21, 2014

(54) LIQUID EJECTION APPARATUS

(71) Applicant: Brother Kogyo Kabushiki Kaisha, Nagoya (JP)

(72) Inventors: Keita Hirai, Nagoya (JP); Atsushi Hirota, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/010,100

(22) Filed: Aug. 26, 2013

(65) Prior Publication Data

US 2014/0063102 A1 Mar. 6, 2014

(30) Foreign Application Priority Data

Aug. 31, 2012 (JP) ..... 2012-190777

(51) Int. Cl.
*B41J 2/07* (2006.01)
*B41J 2/045* (2006.01)

(52) U.S. Cl.
CPC ..... *B41J 2/07* (2013.01); *B41J 2202/10* (2013.01); *B41J 2/04581* (2013.01); *B41J 2/04588* (2013.01)
USPC ..... 347/14; 347/51; 347/56

(58) Field of Classification Search
CPC ..... B41J 2/07
USPC ..... 347/9, 12, 14, 17, 40, 44, 51, 56, 76
See application file for complete search history.

(56) References Cited

U.S. PATENT DOCUMENTS 8,087,757 B2 * 1/2012 Silverbrook ..... 347/62
8,272,708 B2 * 9/2012 Silverbrook et al. ..... 347/14

FOREIGN PATENT DOCUMENTS

JP 2004-098579 A 4/2004

* cited by examiner

*Primary Examiner* — Thinh Nguyen
(74) *Attorney, Agent, or Firm* — Merchant & Gould PC

(57) ABSTRACT

A liquid ejection apparatus includes a liquid ejection head including a plurality of ejection opening groups each constituted by two or more ejection openings and each forming one pixel by at least two liquid droplets ejected from the two or more ejection openings; a plurality of individual channels respectively connecting the plurality of ejection opening groups to a plurality of pressure chambers; a nozzle plate through which a plurality of nozzle holes extend; and an energy-applying portion applying energy to liquid in the plurality of pressure chambers, and a controller controlling the energy-applying portion. The controller controls the energy-applying portion in such a manner as to meet the following inequations: 0.85Ta≤T≤0.9Ta or 1.2Ta≤T in a case of p/D≤1.2, and 0.85Ta≤T in a case of p/D>1.2.

3 Claims, 9 Drawing Sheets

FIG.9

| DIAMETER OF EJECTION OPENING [μm] | p [μm] | D [μm] | p/D | T/Ta | | | | | | | | | | MAXIMUM-MINIMUM DIFFERENCE OF TOTAL AMOUNT OF SHIFTS y [μm] |
|---|---|---|---|---|---|---|---|---|---|---|---|---|---|---|
| | | | | 0.85 | 0.90 | 0.94 | 0.98 | 1.02 | 1.06 | 1.10 | 1.15 | 1.19 | 1.23 | |
| | | | | TOTAL AMOUNT OF SHIFTS ($y = y_1 + y_2$) [μm] | | | | | | | | | | |
| 12.8 | 34 | 34.3 | 0.99 | 2.1 | −1.1 | −3.1 | 0.9 | 4.0 | 3.9 | 4.8 | 3.2 | −2.6 | −5.1 | 10.0 |
| 12.7 | 37 | 34.2 | 1.08 | 9.0 | 9.3 | 3.7 | 6.1 | 14.1 | 13.1 | 13.3 | 8.7 | 7.4 | 7.0 | 10.3 |
| 12.8 | 40 | 34.2 | 1.17 | 5.2 | 4.3 | −0.8 | 2.6 | 6.9 | 5.1 | 7.1 | 1.4 | 1.3 | 5.6 | 7.8 |
| 12.6 | 50 | 34.0 | 1.47 | 8.0 | 6.2 | 2.4 | 3.6 | 7.7 | 6.6 | 6.5 | 3.8 | 4.2 | 4.8 | 5.6 |
| 13.6 | 34 | 35.1 | 0.97 | 4.1 | 3.3 | −6.4 | −3.1 | 4.1 | 1.7 | 2.2 | 1.2 | −5.8 | −4.9 | 10.6 |
| 13.4 | 37 | 34.9 | 1.06 | 4.5 | 3.7 | 1.5 | 2.6 | 8.0 | 10.2 | 9.9 | 6.1 | 1.3 | 0.3 | 9.9 |
| 13.5 | 40 | 35.0 | 1.14 | 4.9 | 4.9 | 4.0 | 6.4 | 11.4 | 9.6 | 9.8 | 6.4 | 5.9 | 6.3 | 7.4 |
| 13.4 | 50 | 34.8 | 1.44 | 4.4 | 4.1 | 2.9 | 4.1 | 7.5 | 6.5 | 6.0 | 4.6 | 3.7 | 4.5 | 4.6 |
| 14.2 | 40 | 35.7 | 1.12 | 3.8 | 5.2 | 3.9 | 7.7 | 25.3 | 22.0 | 18.2 | 11.6 | 7.3 | 4.3 | 21.5 |
| 14.6 | 60 | 36.1 | 1.66 | −0.2 | −0.2 | −0.5 | 0.9 | 3.6 | 3.2 | 1.6 | 1.5 | −0.4 | −1.0 | 4.5 |
| 14.4 | 80 | 35.8 | 2.23 | 0.3 | 2.7 | 1.2 | 1.4 | 2.2 | 1.9 | 1.1 | 0.2 | 0.7 | 1.5 | 2.5 |
| 14.4 | 100 | 35.9 | 2.79 | 0.2 | 0.3 | 0.0 | −0.6 | −2.3 | −2.3 | −1.4 | 0.0 | −1.6 | −1.2 | 2.7 |

LIQUID EJECTION APPARATUS

CROSS REFERENCE TO RELATED APPLICATION

The present application claims priority from Japanese Patent Application No. 2012-190777, which was filed on Aug. 31, 2012, the disclosure of which is herein incorporated by reference to its entirety.

BACKGROUND OF THE INVENTION

1. Field of the Invention

The present invention relates to a liquid ejection apparatus which ejects liquid such as ink or the like.

2. Description of Related Art

There is known a liquid ejection apparatus which includes a recording head having a plurality of ink channels each of which has two nozzle holes.

SUMMARY OF THE INVENTION

The inventor of the present invention found that, in a case where two or more ejection openings were disposed with respect to one individual channel, respective liquid droplets ejected from the two or more ejection openings flew in directions away from each other. The above-mentioned difference between the directions in which the respective liquid droplets fly causes poor quality of an image formed by the liquid droplets.

It is therefore an object of the present invention to provide a liquid ejection apparatus, in a case where there are disposed a plurality of individual channels each of which has two or more ejection openings, to restrain liquid droplets ejected from the two or more ejection openings corresponding to one individual channel from flying in directions away from each other.

In order to achieve the above-mentioned object, according to the present invention, there is provided a liquid ejection apparatus comprising: a liquid ejection head including: a plurality of ejection opening groups each constituted by two or more ejection openings and each configured to form one pixel by at least two liquid droplets ejected from the two or more ejection openings of a corresponding one of the plurality of ejection opening groups; a plurality of individual channels configured to respectively connect the plurality of ejection opening groups to a plurality of pressure chambers; a nozzle plate through which a plurality of nozzle holes, each having the two or more ejection openings at an end thereof, extend, each of the plurality of ejection opening groups comprising two ejection openings formed adjacent to each other; and an energy-applying portion configured to apply energy to liquid in the plurality of pressure chambers such that the liquid droplets are ejected from at least one ejection opening group selected among the plurality of ejection opening groups, and a controller configured to control the energy-applying portion. The controller controls the energy-applying portion in such a manner as to meet the following inequations:

$0.85Ta \leq T \leq 0.9Ta$ or $1.2Ta \leq T$ in a case of $p/D \leq 1.2$, and $0.85Ta \leq T$ in a case of $p/D > 1.2$, where p is a distance between respective centers of the two ejection openings of the ejection opening group, the two ejection openings being formed on an ejection surface of the nozzle plate, D is a diameter of an opening of each of the nozzle holes corresponding to the two ejection openings of the ejection opening group, the opening being formed on a surface opposite to the ejection surface of the nozzle plate, Ta is a resonance period of the individual channel, and T is an ejection period of ink droplets while one pixel is formed.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which:

FIG. 7A is a graph showing a relation between T/Ta and a total amount of shifts y of ink droplets in a plurality of heads different in p/D from each other; and FIG. 7B is a graph showing a relation between p/D and a maximum-minimum difference of the total amount of shifts y (a maximum-a minimum);

FIG. 8A is a graph showing a relation between T/Ta and a total amount of shifts y of ink droplets in a head of $p/D \leq 1.2$; FIG. 8B is a graph showing a relation between T/Ta and a total amount of shifts y of ink droplets in a head of $p/D > 1.2$; and FIG. 9 is a table showing measurement results of the specific example of the present invention.

DETAILED DESCRIPTION OF THE PREFERRED EMBODIMENTS

Figure 1:
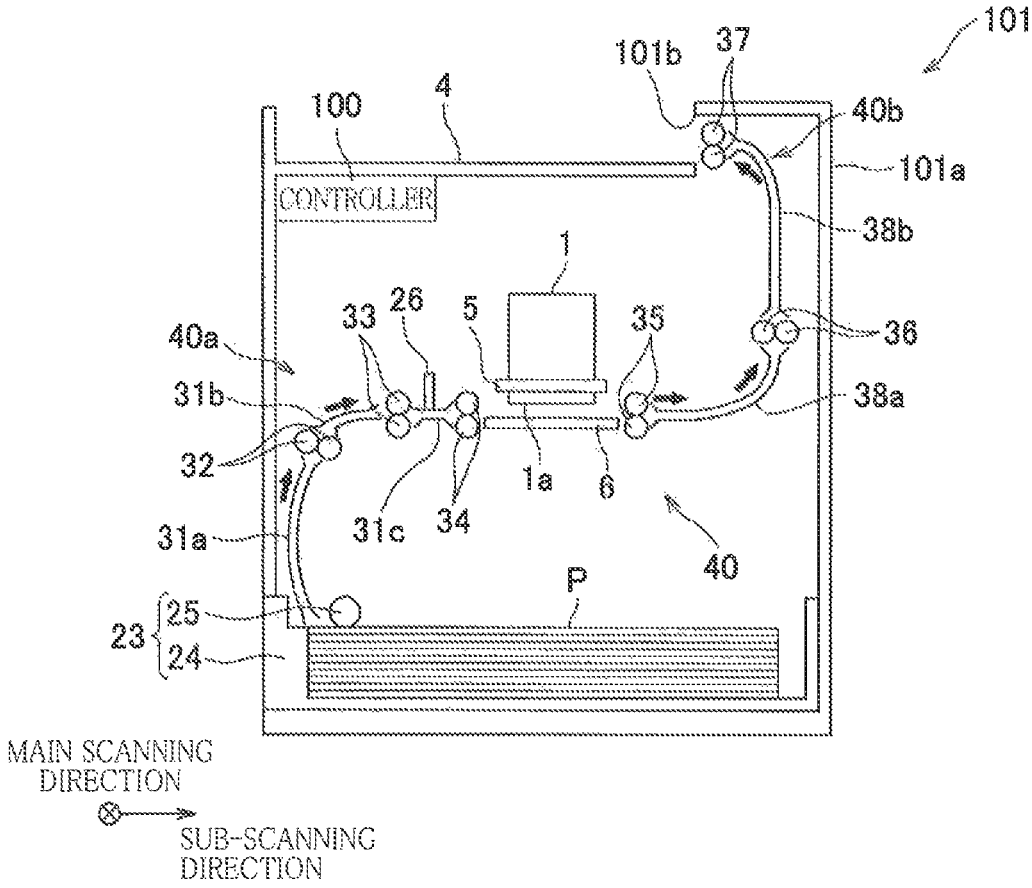
FIG. 1 is a schematic side view showing an internal structure of an inkjet printer as one embodiment to which the present invention is applied.

Hereinafter, there will be described preferred embodiments of the invention with reference to the drawings.

There will be described an overall structure of an inkjet printer 101 as one embodiment to which the present invention is applied with reference to FIG. 1.

The printer 101 includes a casing 101*a* having a rectangular parallelepiped shape. In an upper portion of a top panel of the casing 101*a*, there is disposed a sheet-discharge portion 4. In an inner space of the casing 1*a*, there are disposed a head 1, a platen 6, a sheet sensor 26, a feeding unit 40, a controller 100, and so on. A feeding path through which a sheet P is fed is formed along a thick arrow in FIG. 1 from the sheet-supply unit 23 in a lower portion of the casing 101*a* to the sheet-discharge portion 4.

The head 1 is a line-type head having a generally rectangular parallelepiped shape extending in a main scanning direction (a direction perpendicular to a sheet plane of FIG. 1). A lower surface of the head 1 is an ejection surface 1*a* to which a plurality of ejection openings 108 open (shown in FIG. 2B). The head 1 is supported by the casing 101*a* through a holder 5. There is formed a predetermined clearance between the ejection surface 1*a* and a(n upper) surface of the platen 6.

The head 1 has a laminar structure which includes a head main body 3 (shown in FIG. 2A), a reservoir unit, a flexible printed circuit board (FPC), a circuit board, and so forth that are stacked on each other. The circuit board adjusts signals inputted from the controller 100 and outputs the adjusted signals to a driver IC on the FPC. The driver IC converts the adjusted signals to drive signals and transmits the drive signals to respective electrodes of an actuator unit 21. When the actuator unit 21 is driven based on the drive signals, ink in the reservoir unit is supplied to the head main body 3 so as to be ejected as ink droplets from the ejection openings 108. More detailed structure of the head 1 will be described later.

The platen 6 is a flat plate and has a rectangular shape slightly larger than the ejection surface 1*a* as seen in a direction perpendicular to the ejection surface 1*a*. The platen 6 is opposed to the ejection surface 1*a* and there is formed a predetermined space suitable for recording between the platen 6 and the ejection surface 1*a*.

The sheet sensor 26 is disposed upstream of the head 1 in a feeding direction and detects a leading end of the sheet P. The feeding direction is a direction in which the sheet P is fed by the feeding unit 40. Detection signals outputted from the sheet sensor 26 are inputted to the controller 100.

The feeding unit 40 includes an upstream feeding portion 40*a* and a downstream feeding portion 40*b* between which the platen 6 is disposed. The upstream feeding portion 40*a* includes guides 31*a*, 31*b*, 31*c* and pairs of rollers 32, 33, 34. The downstream feeding portion 40*b* includes guides 38*a*, 38*b* and pairs of rollers 35, 36, 37. Respective ones of the pairs of rollers 32 through 37 are driving rollers that are rotated by driving of a feeding motor 40M (shown in FIG. 4) under the control of the controller 100. The others of the pairs of rollers 32 through 37 are driven rollers that are driven with the driving rollers. Each pair of the guides 31*a* through 31*c*, 38*a*, 38*b* are formed of a pair of plate that are opposed to each other.

The sheet-supply unit 23 includes a sheet-supply tray 24 and a sheet-supply roller 25. The sheet-supply tray 24 is detachably attached to the casing 101*a*. The sheet-supply tray 24 is a box-like structure opening upward and can accommodate a plurality of sheets P. The sheet-supply roller 25 is rotated by driving of a sheet-supply motor 25M (shown in FIG. 4) under the control of the controller 100 so as to supply an uppermost one of the sheets P in the sheet-supply tray 24.

Figure 4:
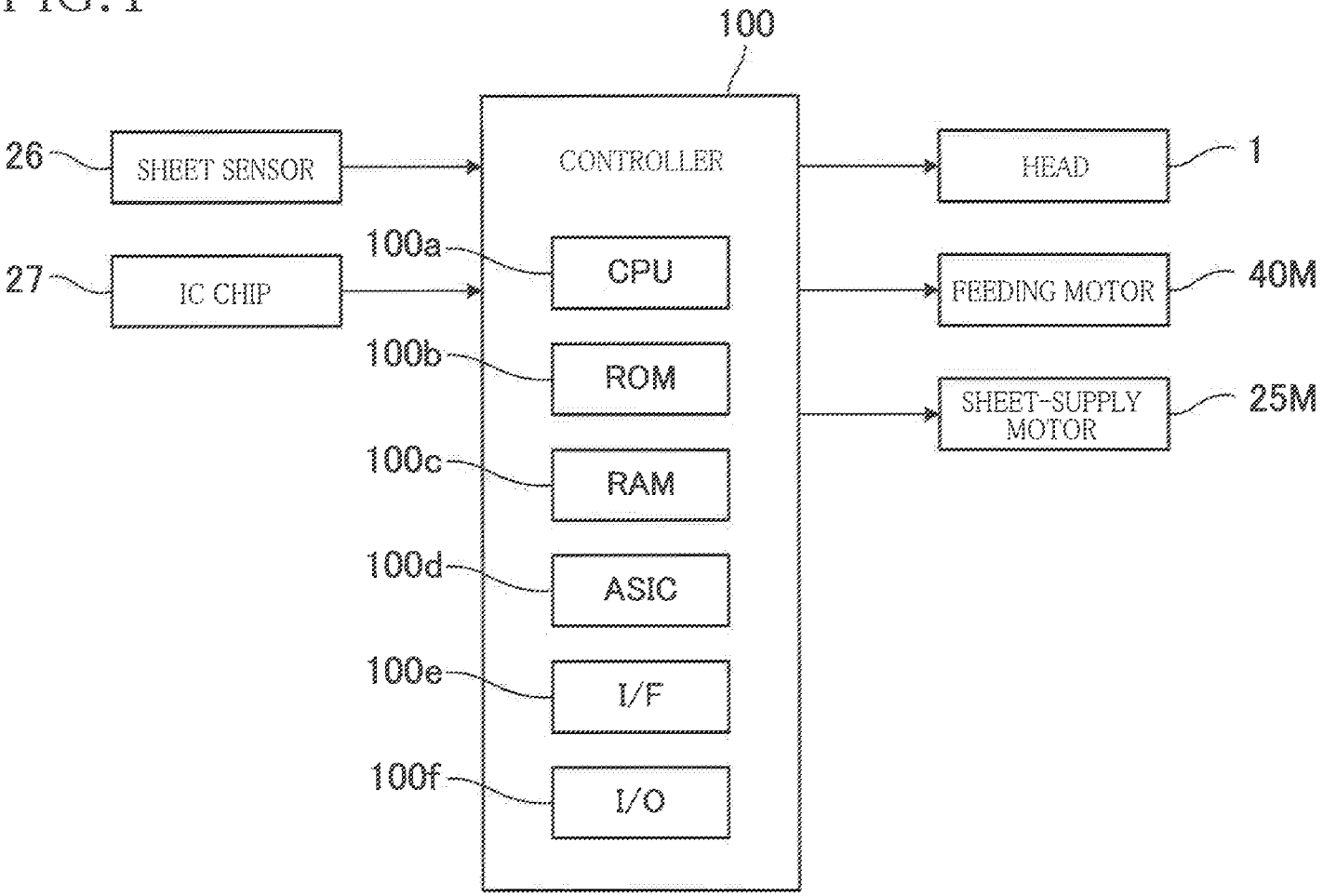
FIG. 4 is a block diagram showing an electrical structure of the printer.

As shown in FIG. 4, the controller 100 includes, in addition to a CPU (Central Processing Unit) 100*a* as an arithmetic processing unit, a ROM (Read Only Memory) 100*b*, a RAM (Random Access Memory: including a nontransitory RAM) 100*c*, an ASIC (Application Specific Integrated Circuit) 100*d*, an I/F (Interface) 100*e*, an I/O (Input/Output Port) 100*f*, and so on. The ROM 100*b* stores programs that are executed by the CPU 100*a*, various fixed data, and so forth. The RAM 100*c* temporarily stores data (image data and so on) necessary when executing of the programs. In the ASIC 100*d*, rewriting, sorting of image data and so on (e.g., signal processing and image processing) are performed. The I/F 100*e* transmits and receives data to and from an external device, e.g., a PC (Personal Computer) connected to the printer 101. The I/O 100*f* performs input/output of detection signals of various sensors. The controller 100 may not include the ASIC 100*d* and rewriting, sorting of image data and so on may be performed by programs and the like that are executed by the CPU 100*a*.

Based on recording command from the external device, the controller 100 controls preparatory operations related to recording, supplying, feeding and discharging operations of the sheet P, ejection of ink droplets that is synchronized with the feeding of the sheet P, and so forth such that an image is recorded on the sheet P. The sheet P supplied from the sheet-supply unit 23 is nipped by the pair of rollers 32 through 37 and guided by the guides 31*a* through 31*c*, 38*a*, 38*b* so as to be fed to the sheet-discharge portion 4. Upstream of the head 1 in the feeding direction on the way to the sheet-discharge portion 4, the sheet sensor 26 detects the leading end of the sheet P. When the sheet P passes right below the head 1, while a (back or lower) surface of the sheet P is supported by the platen 6, an image is recorded on the other (an upper) surface of the sheet P. When recording, the head 1 is driven by the control of the controller 100. The ejection of ink droplets from the ejection openings 108 starts based on the detection signal from the sheet sensor 26 and is performed based on image data. The sheet P on which the image has been recorded is discharged from an opening 101*b* formed in an upper portion of the casing 101*a* to the sheet-discharge portion 4.

Hereinafter, a structure of the head 1 will be described in detail with reference to FIGS. 2A, 2B and 3A, 3B.

Figure 2A:
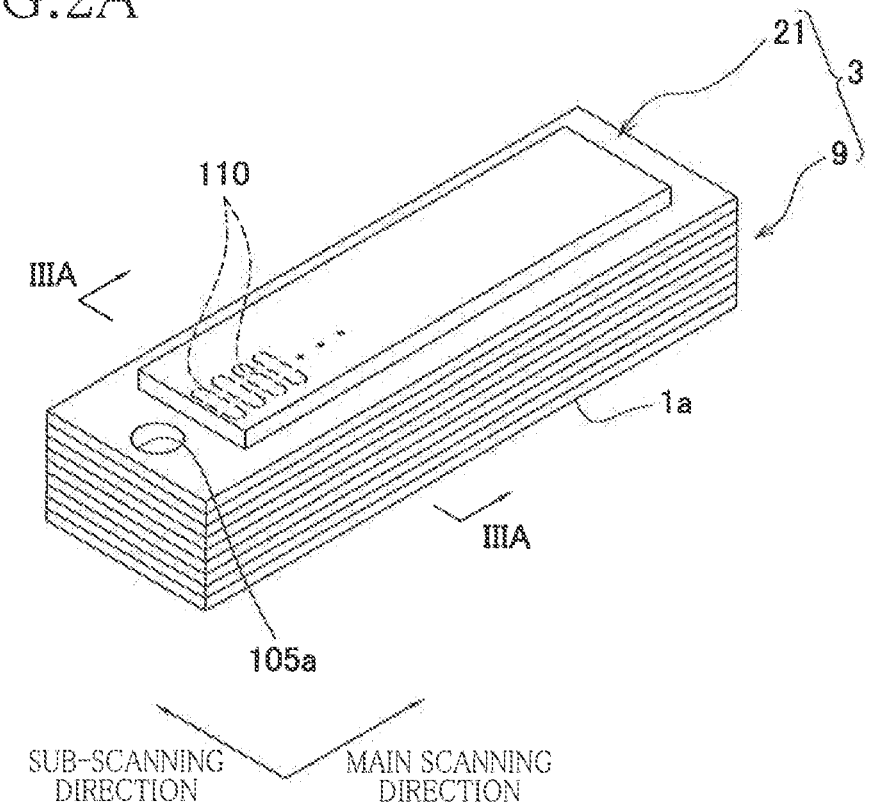
FIG. 2A is a perspective view schematically showing a head main body of a head of the inkjet printer shown in FIG. 1.

As shown in FIG. 2A, the head main body 3 includes a channel unit 9 and the actuator unit 21, and has a generally rectangular parallelepiped shape extending in the main scanning direction.

Figure 3A:
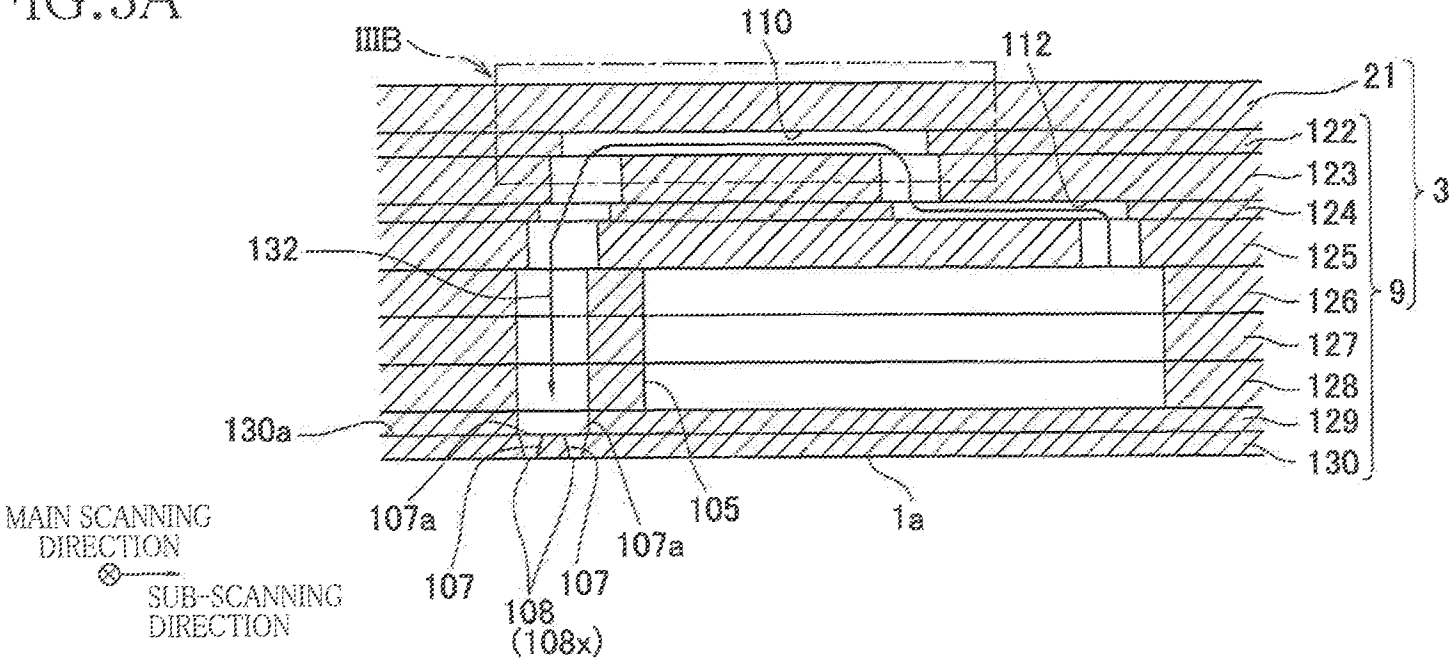
FIG. 3A is a cross-sectional view taken along a line IIIA-IIIA in FIG. 2A.

As shown in FIGS. 2A and 3A, the channel unit 9 has a laminar structure which includes rectangular metallic plates 122, 123, 124, 125, 126, 127, 128, 129, 130 having generally the same size and that are stacked on each other. As shown in FIG. 2A, at an upper surface of the channel unit 9, there are formed one supply opening (an inlet) 105*a* and respective openings of a plurality of pressure chambers 110. The openings of the plurality of pressure chambers 110 are aligned in the main scanning direction. As shown in FIG. 3A, a manifold channel 105 and a plurality of individual channels 132 are formed in the channel unit 9. The manifold channel 105 has the supply opening 105*a* on one of opposite ends thereof and is connected to the plurality of individual channels 132. The manifold channel 105 extends in the main scanning direction. Each of the individual channels 132 extends from an outlet of the manifold channel 105 via an aperture 112 functioning as a throttle valve for adjusting a channel resistance and the pressure chamber 110 to an ejection opening group 108*x*. A lower surface of the channel unit 9 is the ejection surface 1*a*.

Figure 2B:
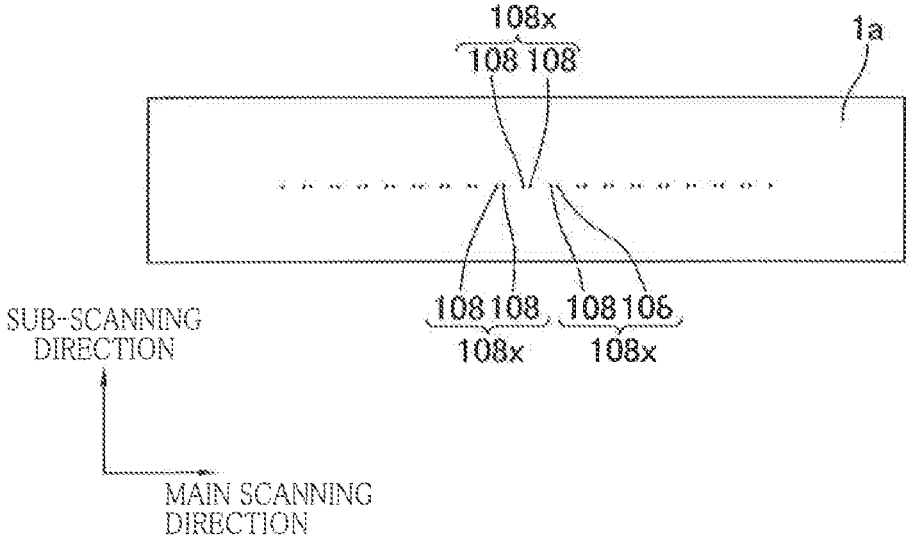
FIG. 2B is a plan view of an ejection surface of the head.

The ejection opening group 108, as shown in FIG. 2B, is constituted by two ejection openings 108 adjacent to each other in the main scanning direction. A plurality of ejection opening groups 108 are disposed at equal intervals in the main scanning direction. One ejection opening group 108*x* and one pressure chamber 110 are connected to each other through one individual channel 132. Ink droplets are simultaneously ejected from two ejection openings 108 constituting each ejection opening group 108*x* such that one pixel is formed by the ink droplets. Pixels are composing elements for forming an image recorded on the sheet P, and are arranged like a matrix corresponding to an image recording area on the sheet P.

A lowermost layer of the channel unit 9 is a nozzle plate 130 in which the ejection openings 108 are formed, and a lower surface of the nozzle plate 130 is the ejection surface 1*a*. A plurality of nozzle holes 107 penetrate through the nozzle plate 130 and connect the ejection openings 108 to openings 107*a* formed at an upper surface 130*a* of the nozzle plate 130. As seen in a plan view of the nozzle plate 130 (the channel unit 9), the ejection opening 108 and the opening 107*a* are coaxial and each has a circular shape, and the opening 107*a* includes the ejection opening 108. In other words, the nozzle hole 107 has a taper shape so as to be tapered off from the opening 107*a* to the ejection opening 108 as seen in a direction parallel to the ejection surface 1*a*.

The reservoir unit is fixed to the upper surface of the channel unit 9. In the reservoir unit, there is formed a reservoir which temporarily stores ink. Ink is supplied from a cartridge (not shown) to the reservoir. Ink in the reservoir is supplied to the channel unit 9 through the supply opening 105*a*.

As shown in FIG. 2A, the actuator unit 21 is fixed to the upper surface of the channel unit 9. The actuator unit 21 has a rectangular shape extending in the main scanning direction as seen in a direction perpendicular to the ejection surface 1*a*, and seals openings of all pressure chambers 110 so as to form a side wall of the pressure chamber 110.

Figure 3B:
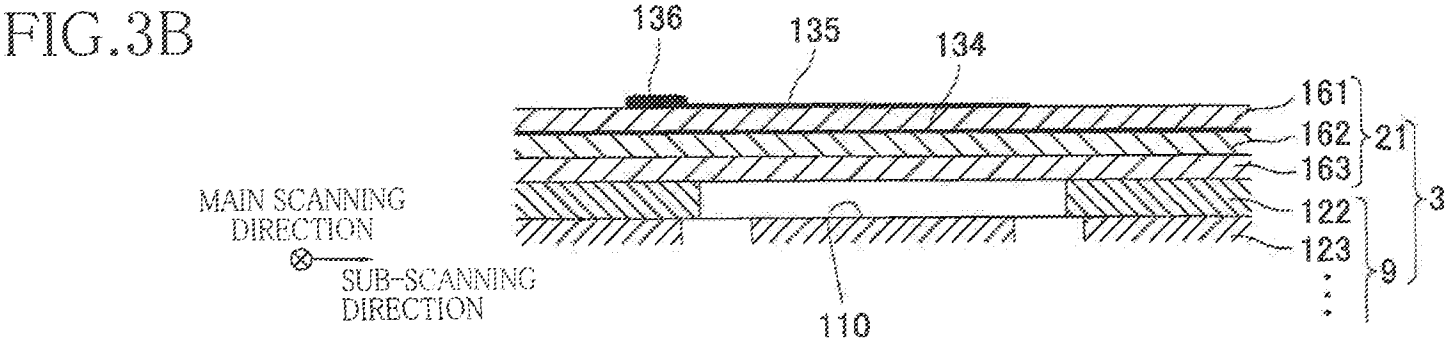
FIG. 3B is an enlarged view showing an area IIIB enclosed by a one-dot chain line in FIG. 3A.

As shown in FIG. 3B, the actuator unit 21 includes three piezoelectric layers 161, 162 163, individual electrodes 135 and a common electrode 134. Each of the piezoelectric layers 161, 162, 163 is formed of ferroelectric lead zirconate titanate (PZT) ceramics, and covers all pressure chambers 110. The individual electrodes 135 are disposed on an upper surface of the piezoelectric layer 161 corresponding to each pressure chamber 110. The common electrode 134 extends between the piezoelectric layers 161, 162 so as to cover all pressure chambers 110. Each individual electrode 135 has an opposing portion opposed to the corresponding pressure chamber 110 and non-opposing portion not opposed to the corresponding pressure chamber 110. A land 136 is formed in the non-opposing portion of each individual electrode 135. The land 136 is connected to a terminal of the FPC, not shown.

The piezoelectric layer 161 is polarized in its thickness direction and has an active portion interposed between the individual electrode 135 and the common electrode 134. The active portion is displaced in at least one (in the present embodiment, $d_{31}$) selected among three oscillation modes $d_{31}$, $d_{33}$, $d_{15}$. Portions of the piezoelectric layers 162, 163 opposed to the active portion are non-active portions. In other words, the actuator unit 21 includes unimorph-type piezoelectric actuators each having a laminar structure in which one active portion and two non-active portions for each pressure chamber 110 are stacked on each other. When electric field is applied to the active portion in a direction of polarization, the active portion shrinks in a direction perpendicular to the direction of polarization (in a planar direction of the piezoelectric layer 161). Since a difference in deformation between the active portion and the non-active portion occurs, the actuator deforms in a convex manner toward the pressure chamber 110 (a unimorph deformation). Accordingly, each actuator is independently deformable. Drive modes of the actuators and ejection states of ink droplets according to the drive modes will be described in detail later.

Figure 5:
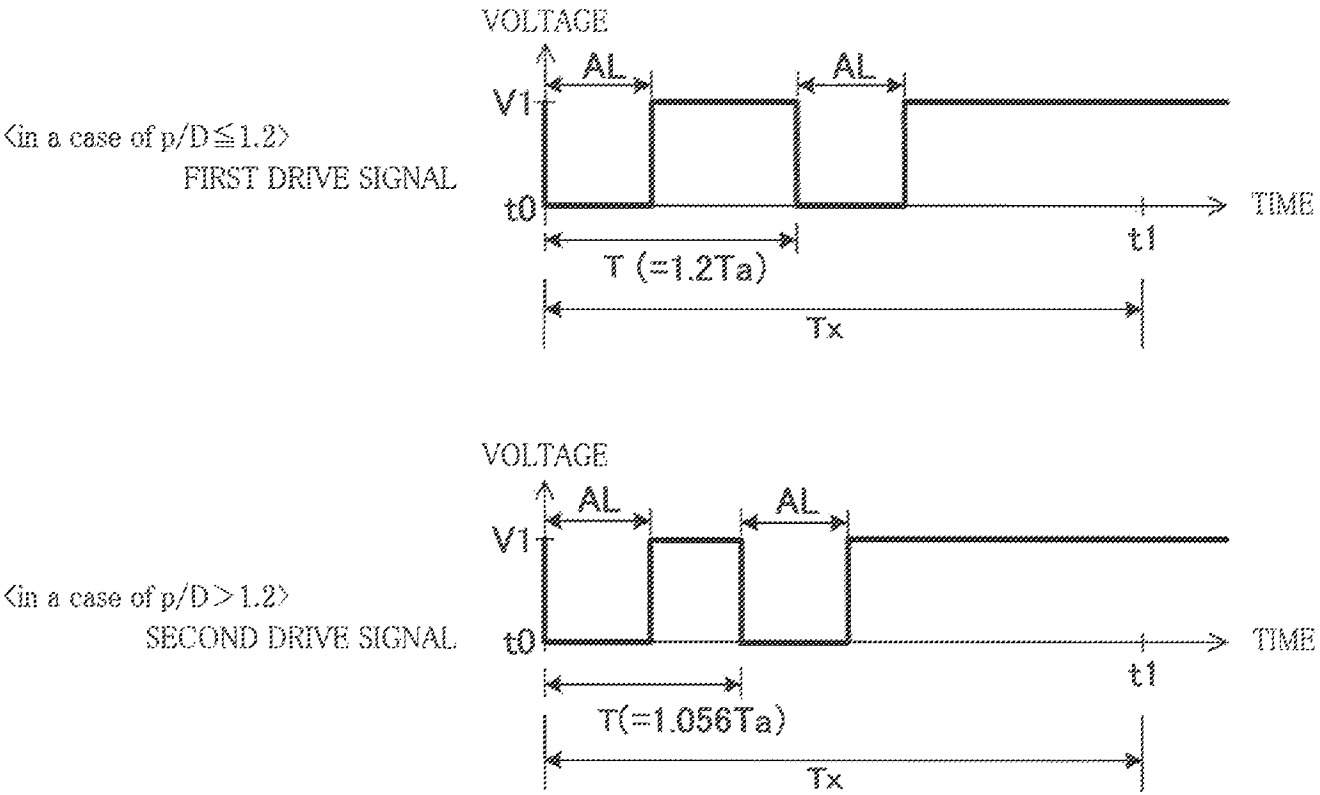
FIG. 5 is a graph showing drive signals used for driving of an actuator unit corresponding to respective cases of $p/D \leq 1.2$ and $p/D > 1.2$, in a case where an amount of ink droplets forming one pixel is medium.

Hereinafter, drive signals used for the drive of the actuator unit 21 will be described with reference to FIG. 5.

In the present embodiment, a plurality of drive signals are prepared corresponding to gradations and values p/D. The gradations depend on an amount of ink forming one pixel and correspond to numbers of times of ejection within one recording period Tx. In gradations that require a plural numbers of times of ejection, even in a case where the numbers of times of ejection are the same, a plurality of drive signals each having different ejection periods T are prepared corresponding to the values p/D. This is because intervals between successive ejections are small and the size of the intervals greatly affects an amount of distance (a total amount of shifts) between the two ink droplets ejected in one ejection. For example, as shown in FIG. 5, two drive signals are prepared. In gradations that require one ejection, an ejection period T is long so as to equal the recording period Tx, so that interaction between the ejections can be ignored. In this case, since changing of the recording period Tx during printing leads to difficulty in control, one drive signal is prepared. In the gradation that requires the plurality of ejections, the controller 100 selects, in a case of $p/D \leq 1.2$, i.e., p/D is equal to or smaller than 1.2, a first drive signal (T=1.2Ta) in which the ejection period T is long, and, in a case of $p/D > 1.2$, i.e., p/D is greater than 1.2, a second drive signal (T=1.056Ta) in which the ejection period T is short. The value Ta is a resonance period of the individual channel 132.

Figure 6:
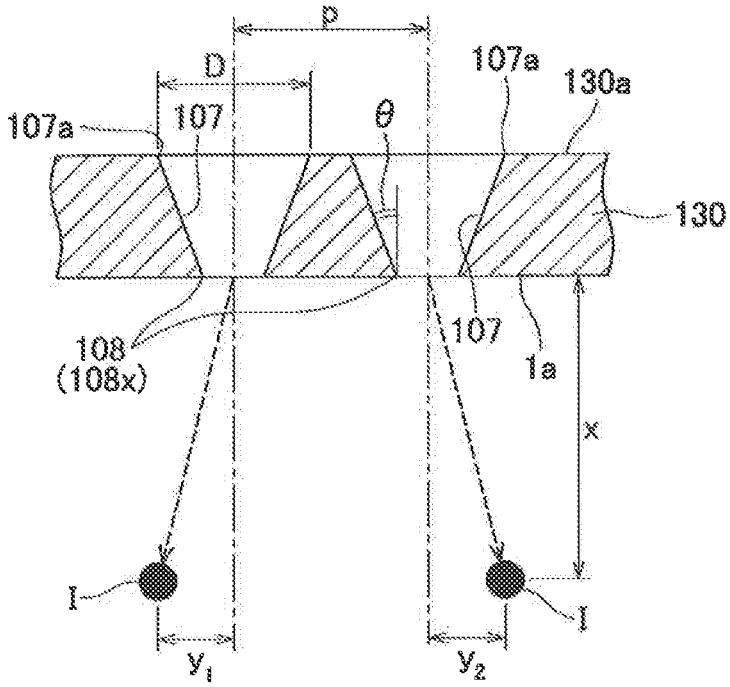
FIG. 6 is a cross-sectional view showing a nozzle plate including two nozzle holes constituting an ejection opening group and showing a state in which ink droplets ejected from two ejection openings of the ejection opening group fly in directions away from each other.

The one recording period Tx means a time period needed for moving of the sheet P relative to the head 1 by a unit distance corresponding to resolution of an image recorded on the sheet P. In the horizontal axis of FIG. 5, a time point t0 is a start time point of the recording period Tx and a time point t1 is an end time point of the recording period Tx. The ejection period T means a period of ink ejections within the one recording period Tx and is an appearance pitch of voltage pulse. The ejection period T is related to the resonance period Ta of the individual channel 132. As shown in FIG. 6, the value p is a distance between respective centers of the two ejection openings 108 constituting the ejection opening group 108*x* on the ejection surface 1*a*. The value D is a diameter of the opening 107*a* on the upper surface 130*a*.

The drive signals change a potential of the individual electrode 135 between a ground potential (0V) and a high potential V1 (>0V). The common electrode 134 always stays at the ground potential. In any of the drive signals, durations of voltage pulses (rectangular and pulsed change in voltage from fall to rise of voltage) are constant and are equal to the AL (Acoustic Length: a one-way propagation time of pressure wave in the individual channel 132.

In the present embodiment, as a drive method of the actuator, what is called "fill-before-fire method" is adopted, in which ink is supplied to the pressure chamber 110 before ejection of ink droplets. More specifically, the individual electrode 135 is previously kept at the high potential V1 such that the actuator is deformed in a convex manner toward the pressure chamber 110. Then, when a potential of the individual electrode 135 is changed to the ground potential at a predetermined timing, the actuator is changed from the convex state toward the pressure chamber 110 to a state parallel to the ejection surface 1*a* so as to increase a volume of the pressure chamber 110. Accordingly, ink is supplied into the pressure chamber 110. Then, when the potential of the individual electrode 135 is changed again to the high potential V1 at a predetermined timing, the actuator is changed from the state parallel to the ejection surface 1*a* to the convex state toward the pressure chamber 110 so as to decrease the volume of the pressure chamber 110. Accordingly, pressure (ejection energy) is applied to the ink in the pressure chamber 110 such that ink droplets are simultaneously ejected from the two ejection openings 108 of the corresponding ejection opening group 108*x*.

In the present embodiment, there are four gradation levels such as zero, small, medium and large, and ink amounts for forming one pixel increase in this order. Numbers of times of ejection movement (a series of movement composed of the ink supply and the ejection of ink droplets or a number of ejection for one pixel) are zero, one, two and three times corresponding to the four gradation levels of zero, small, medium and large. One ejection movement corresponds to one voltage pulse. Except a case of the gradation level of zero, as the last drive signal, a pulse for suppressing vibration (a cancel pulse) may be added after the last voltage pulse, so that residual vibration is suppressed.

Data on the drive signals are stored in the ROM 100*b*. Each of the values of p, D, Ta is stored in an IC chip 27 that is mounted in the head 1, and is read out by the controller 100 when the power is on and temporarily stored in the RAM 100*c*. The IC chip 27 is an output means for outputting the values p, D corresponding to the request of the controller 100. The controller 100, in the image forming, acquires the values p, D by accessing the RAM 100*c*. As an output means, input keys by a user for inputting the values p, D may be used. The input keys output signals corresponding to the values p, D to the controller 100. Further, the controller determines whether p/D≤1.2 (p/D is equal to or smaller than 1.2) based on the acquired values p, D. Corresponding to the respective cases of p/D≤1.2 and p/D>1.2, the controller 100, for each pixel, selects one of the plurality of drive signals stored in the ROM 100*b* for each ejection and controls the actuator unit 21 by using the drive signal.

While, in a case of one ejection opening 108, the ink droplet I flies along a line of axis of the nozzle hole 107, in a case where there are two ejection openings 108, as shown in FIG. 6, the ink droplets I fly in directions away from each other. These ink droplets I are positioned, at a distance x from the ejection surface 1*a*, at respective positions shifted from desired positions by amounts of shift y1, y2. Here, it is assumed that the amounts of shift y1, y2 of the ink droplets I respectively ejected from the two ejection openings 108 are nearly equal to each other. The amounts of shift y1, y2 are respectively amounts of shift from imaginary lines passing respective centers of the ejection openings 108 and perpendicular to the ejection surface 1*a*.

As described later in a specific example, in the case of p/D≤1.2, the first drive signal (T=1.2Ta) is used, and the amounts of shift of the ink droplets I in flying directions in which the ink droplets I fly become small. In a case of p/D>1.2, the second drive signal (T=1.056Ta) is used, and the amounts of shift of the ink droplets I in the flying directions become small. In both cases, the amounts of shift of the ink droplets I become close to a case of the gradation level "small".

As described above, in the present embodiment, since the flying directions of the ink droplets (the total amount of shifts y) change depending on the ejection periods T as described later in the specific example, and the actuator unit 21 as an energy-applying portion is controlled by the ejection periods T which meet the above-mentioned conditions corresponding to the values p, D and Ta, the ink droplets can be restrained from flying in the directions away from each other. Therefore, in a case where there are disposed a plurality of individual channels each of which has two or more ejection openings, ink droplets ejected from the two or more ejection openings corresponding to one individual channel can be restrained from flying in the directions away from each other.

Furthermore, the printer 101 in the present embodiment further includes the IC chip 27 as an output portion which outputs the values p, D and Ta, and the ROM 100*b* as a storing portion which stores data on the two drive signals different in the values T from each other. The printer 101 selects one of the two drive signals stored in the ROM 100*b* based on the values p, D, Ta outputted from the IC chip 27, so that the ink droplets can be more effectively restrained from flying in the directions away from each other.

Apparently in the specific example described later, in the present embodiment, first and second drive signals that meet the following conditions may be used instead of the drive signals shown in FIG. 5:

0.85Ta≤T≤0.9Ta or 1.2Ta≤T in a case of p/D≤1.2, and 0.85Ta≤T in a case of p/D>1.2

Especially in the case of p/D>1.2, it is preferable that a drive signal which meets 0.95Ta≤T≤1.15Ta is used as the second drive signal. The reason for this is as follows. As the value T is close to the value Ta, amplification of pressure wave due to superimposed pressure wave occurred in the individual channel 32 becomes large and an ejection speed becomes large. In a case where the ejection speed is small, positions where the ink droplets land are hard to be stabilized due to influence of air flow and so on, and, especially in a case where ink droplets are ejected from the ejection openings 108 while the recording sheet P as a recording medium is moved relatively to the ejection openings 108, amounts of shifts of the positions where the ink droplets land according to the shifts of the ink droplets in the flying directions become large. Since the actuator unit 21 is controlled based on the above-mentioned condition (0.95Ta≤T≤1.15Ta in the case of p/D≤1.2), the ejection speed can be made large, so that degrading in image quality can be more surely restrained.

Hereinafter, the present invention will be more specifically described with the specific example.

In the specific example, a plurality of heads 1 different in the value of p/D from each other are prepared, and in each head 1, the actuator unit 21 is controlled by using the plurality of drive signals different in the ejection periods T from each other, and the total amount of shifts y (=y1+y2) of the ink droplets I at the distance x (=1 mm) from the ejection surface 1*a* is measured. Measurement results are shown in FIGS. 7, 8 and 9. Each of the graphs of FIGS. 7, 8 is graphically illustrated based on numerical values of FIG. 9. In FIG. 9, a diameter D of an incoming opening (one opening opposite to the ejection opening 108) of the nozzle hole 107 and the total amount of shifts y are average values with respect to each head 1.

Figure 7A:
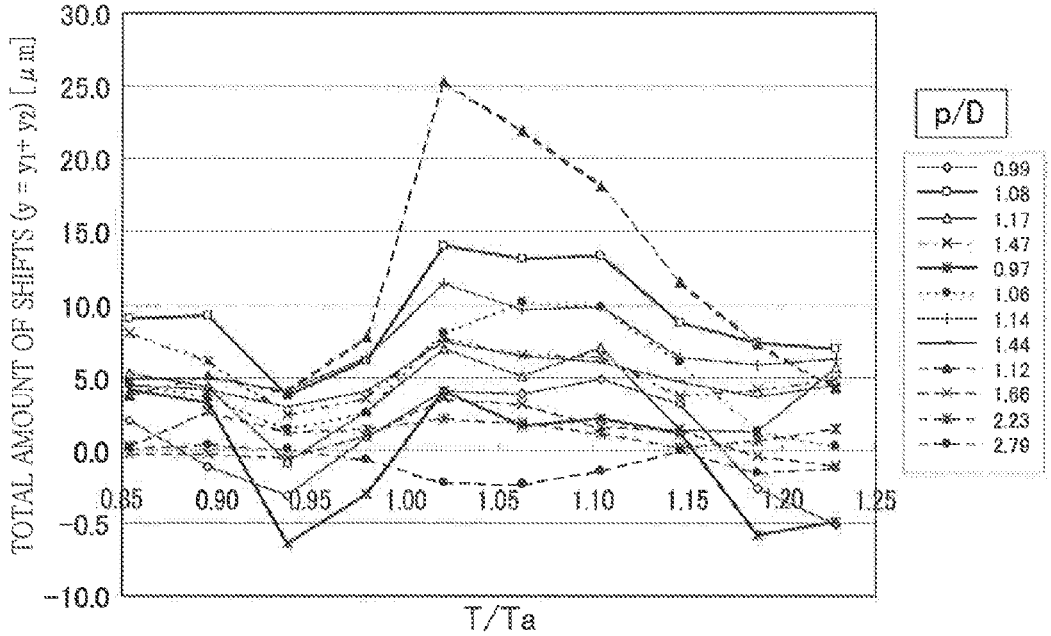
FIGS. 7A and 7B are graphs showing measurement results of a specific example of the present invention.
Figure 7B:
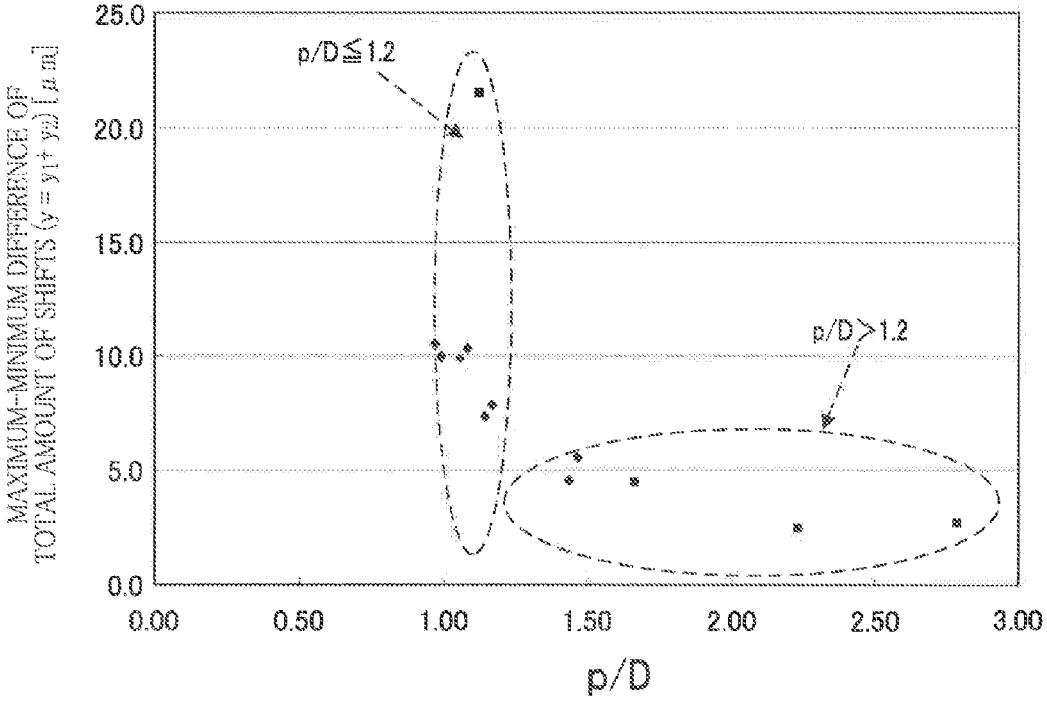

In a case where the ejection period T is close to the resonance period Ta, as shown in the FIG. 7A, the total amount of shifts y changes depending on the ejection periods T, i.e., the flying directions of the ink droplets I change depending on the ejection periods T. Further, FIGS. 8A, 8B indicates that, in the case of p/D≤1.2, changes in the total amounts of shift y are large in most of the ejection periods T, i.e., the shifts of the ink droplets I in the flying directions are large. Therefore, as shown in FIG. 7B, in the case of p/D≤1.2, a difference between maximum and minimum of the total amount of shifts y is large, i.e., an amount of changes of the ink droplets I in the flying directions depending on the ejection periods T is large. The above-described phenomena occurring in the case of p/D≤1.2 can be explained due to interference between the nozzle holes 107. In the present embodiment, the nozzle holes 107 are formed by press working to the nozzle plate. Therefore, as the distance between respective centers of the two ejection openings 108 decreases compared to the diameter D of the incoming opening of the nozzle hole 107, distortion of the nozzle plate 30 occurs during the press working, leading to loss of parallelism between axis lines of the respective nozzle holes 107 (loss of telecentricity in ejection). In the press working, since holes adjacent to each other are made in order, a distance of axis lines of the holes has a tendency to become large in a downward direction comparing to desired axis lines of the holes. Further, in the vicinity of T=Ta, intensity of pressure wave in the individual channel 132 is large, so that ejection characteristics is easily influenced by the distortion.

Figure 8A:
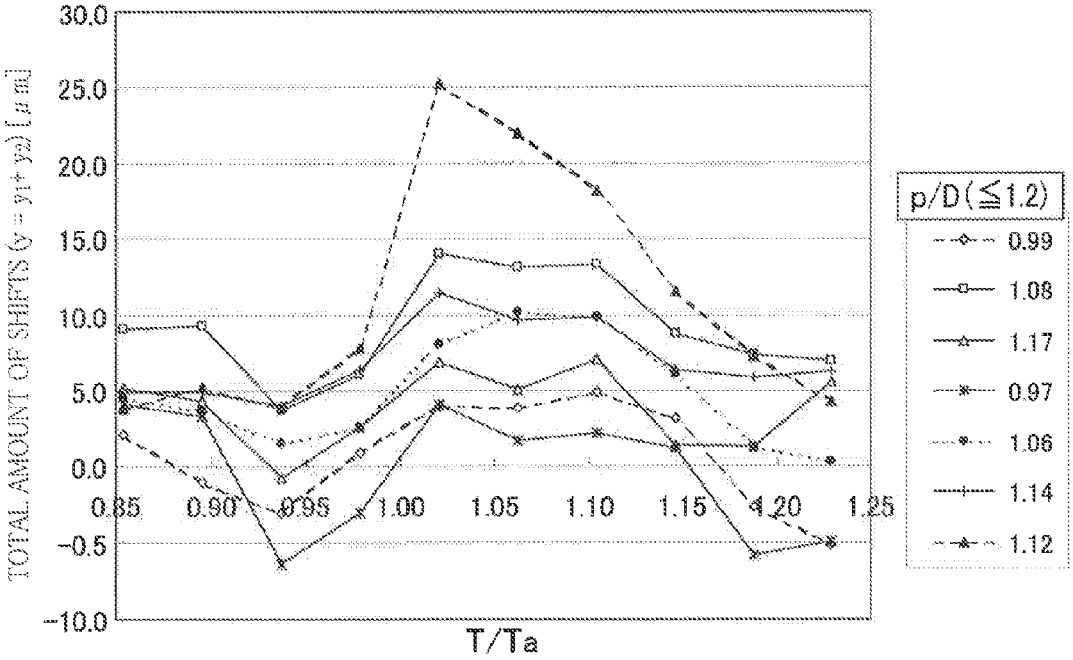
FIGS. 8A and 8B are graphs showing measurement results of a specific example of the present invention.
Figure 8B:
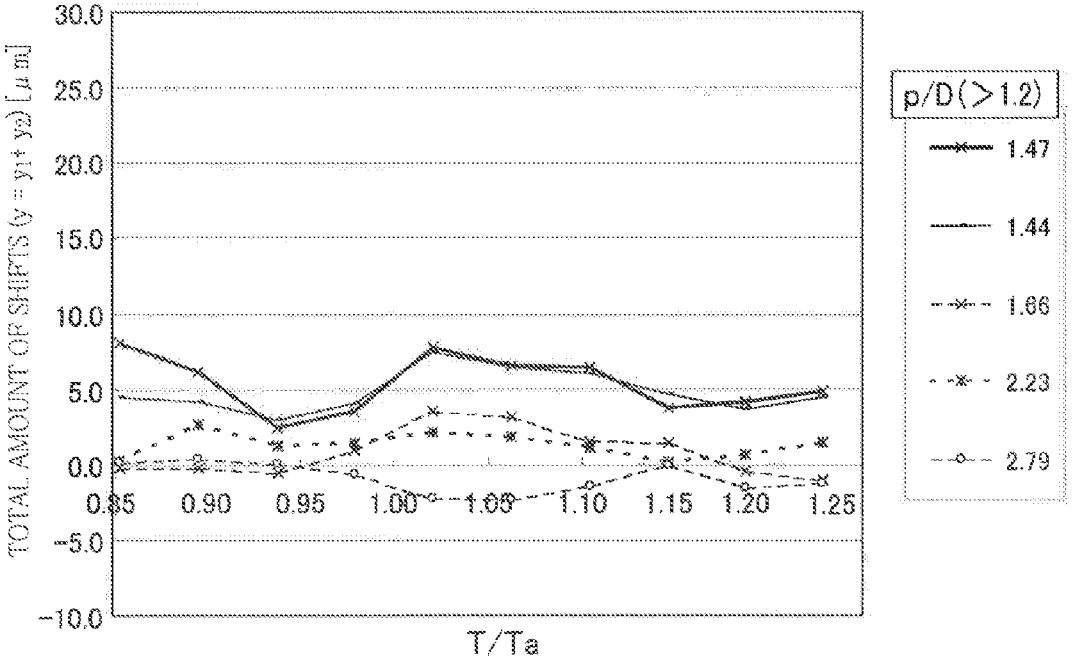

On the other hand, in the case of p/D>1.2, FIGS. 8A, 8B shows that the total amounts of shifts y are small in most of the ejection periods T, i.e., the shifts of the ink droplets I in the flying directions are small. Further, FIG. 7B shows that, in the case of p/D>1.2, a difference between maximum and minimum of the total amount of shifts y is also small, i.e., an amount of changes of the ink droplets I in the flying directions depending on the ejection periods T is small.

Furthermore, FIG. 8A shows that, in the case of p/D≤1.2, within a range of 0.85Ta≤T≤0.9Ta or 1.2 Ta≤T, the total amount of shifts y (=ya) is relatively small and generally constant with respect to the ejection period T. Within a range of 0.9Ta<T<1.2Ta, changes in the total amount of shifts y with respect to the ejection period T is relatively large. Therefore, in this range, a difference between maximum and minimum of the total amount of shifts y is large. Specifically, within a range of 0.9Ta<T≤0.98Ta, the total amount of shifts is the total amount of shifts yb that is smaller than the total amount of shifts ya, and, within a range of 0.98Ta<T<1.2Ta, the total amount of shifts is the total amount of shifts yc that is larger than the total amount of shifts ya.

In all heads 1 used in the specific example, a thickness of the nozzle plate 130 is 30 μm and a taper angle θ of the nozzle hole 107 is 19.7°. Further, all heads 1 used in the specific example are generally the same in channel structure and the values AL, Ta. In the specific example, although influence on measurement results due to difference in channel structure is not considered, it is supposed that, in a case where the value Ta is acquired, which depends on the channel structure, the similar results as in the specific example can be obtained based on the value Ta.

The present invention is not limited to the illustrated embodiment. It is to be understood that the present invention may be embodied with various changes and modifications that may occur to a person skilled in the art, without departing from the spirit and scope of the invention defined in the appended claims.

The controller, in gradations that require a plurality of ejections, is not limited to the use of the plurality of drive signals different from each other for each gradation level. For example, in a case where the number of gradations is two or more, the controller may use the plurality of drive signals different from each other only in one level of the gradations. Further, in the case of p/D≤1.2, in the illustrated embodiment, although the drive signal of T=1.2 Ta is used, a drive signal within the range of 0.85Ta≤T≤0.9Ta or 1.2 Ta≤T may be used. In the case of p/D>1.2, in the illustrated embodiment, although the drive signal of T=1.056Ta is used, a drive signal within the range of 0.85Ta≤T may be used. In the case of p/D>1.2, as shown in FIG. 8B, p/D>1.66 is preferable, which makes the total amount of shifts y the smallest. Furthermore, the energy-applying portion is not limited to piezoelectric-type, but may be another type such as thermal-type in which a heating element is used, electrostatic-type in which electrostatic force is used, and so on. Furthermore, the number of ejection openings constituting the ejection opening group is not limited to two, but may be three or more. In this case, it is preferable that the value p is the smallest one of distances between respective centers of respective two of the three or more ejection openings adjacent to each other. In a case where diameters of respective openings of a plurality of nozzle holes constituting the ejection opening group are different from each other, it is preferable that the value D is an average value of the diameters. It is not limited that the ejection openings constituting the ejection opening group are aligned in the main scanning direction, but the ejection openings may be arranged in an inclined direction with respect to the main scanning direction. The channel structure including the individual channels in the liquid ejection head can be properly changed. Further, the number of the liquid ejection head disposed in the liquid ejection apparatus may be any number that is one or more. The liquid ejection head may eject any liquid other than ink. Furthermore, the liquid ejection head is not limited to line-type, but may be serial-type. The liquid ejection apparatus is not limited to the printer, but may be a facsimile machine, a copier machine, and so on. Moreover, the recording medium is not limited to the sheet, but may be any medium that is recordable.

What is claimed is:

1. A liquid ejection apparatus comprising a liquid ejection head including:

a plurality of ejection opening groups each constituted by two or more ejection openings and each configured to form one pixel by at least two liquid droplets ejected from the two or more ejection openings of a corresponding one of the plurality of ejection opening groups;

a plurality of individual channels configured to respectively connect the plurality of ejection opening groups to a plurality of pressure chambers;

a nozzle plate through which a plurality of nozzle holes, each having the two or more ejection openings at an end thereof, extend, each of the plurality of ejection opening groups comprising two ejection openings formed adjacent to each other; and an energy-applying portion configured to apply energy to liquid in the plurality of pressure chambers such that the liquid droplets are ejected from at least one ejection opening group selected among the plurality of ejection opening groups, and a controller configured to control the energy-applying portion, wherein the controller controls the energy-applying portion in such a manner as to meet the following inequations:

0.85Ta≤T≤0.9Ta or 1.2Ta≤T in a case of p/D≤1.2, and 0.85Ta≤T in a case of p/D>1.2, where p is a distance between respective centers of the two ejection openings of the ejection opening group, the two ejection openings being formed on an ejection surface of the nozzle plate, D is a diameter of an opening of each of the nozzle holes corresponding to the two ejection openings of the ejection opening group, the opening being formed on a surface opposite to the ejection surface of the nozzle plate, Ta is a resonance period of the individual channel, and T is an ejection period of ink droplets while one pixel is formed.

2. The liquid ejection apparatus according to claim 1, further comprising:

an output portion configured to output the p, D and Ta; and a storing portion configured to store a plurality of drive signals including two drive signals different in the ejection periods T from each other, wherein the controller controls the energy-applying portion to form one pixel by selecting one of the plurality of drive signals stored in the storing portion, based on the p, D and Ta outputted from the output portion.

3. The liquid ejection apparatus according to claim 1, wherein the controller controls the energy-applying portion in such a manner as to meet the following inequation:

0.95Ta≤T≤1.15Ta in a case of p/D>1.2.

* * * * *